US011035554B2

(12) United States Patent
Chen et al.

(10) Patent No.: US 11,035,554 B2
(45) Date of Patent: Jun. 15, 2021

(54) MOTION SENSITIVE LAMP WITH COUPLING MECHANISM

(71) Applicant: LivingStyle Enterprises Limited, Dong Guan (CN)

(72) Inventors: Ming-Yun Chen, Dong Guan (CN); Chih-Hung Chen, Dong Guan (CN)

(73) Assignee: LIVINGSTYLE ENTERPRISES LIMITED, Dong Guan (CN)

( * ) Notice: Subject to any disclaimer, the term of this patent is extended or adjusted under 35 U.S.C. 154(b) by 0 days.

(21) Appl. No.: 16/934,152

(22) Filed: Jul. 21, 2020

(65) Prior Publication Data

US 2021/0025572 A1 Jan. 28, 2021

(30) Foreign Application Priority Data

Jul. 26, 2019 (CN) ..... 201921191404.8

(51) Int. Cl.

| | |
|---|---|
| ***F21V 21/02*** | (2006.01) |
| ***F21V 23/06*** | (2006.01) |
| ***F21S 8/00*** | (2006.01) |
| ***F21V 5/00*** | (2018.01) |
| ***F21V 23/04*** | (2006.01) |

(52) U.S. Cl.
CPC ..... *F21V 21/02* (2013.01); *F21S 8/03* (2013.01); *F21V 5/002* (2013.01); *F21V 23/0471* (2013.01); *F21V 23/06* (2013.01)

(58) Field of Classification Search
None
See application file for complete search history.

(56) References Cited

U.S. PATENT DOCUMENTS

2015/0338077 A1* 11/2015 Johnson ..... F21V 23/005 362/234

* cited by examiner

*Primary Examiner* — Vip Patel
(74) *Attorney, Agent, or Firm* — WPAT, PC

(57) ABSTRACT

A motion sensitive lamp with a coupling mechanism is provided. The motion sensitive lamp is installed on a wall or a ceiling. The motion sensitive lamp at least includes a lamp body, a base and a coupling mechanism. A coupling mechanism includes an engaging structure, a positioning structure and a limiting element. One of the engaging structure and the positioning structure is installed on the lamp body. The other of the engaging structure and the positioning structure is installed on the base. The engaging structure is inserted into the positioning structure, so that the lamp body is locked on or coupled with the base. When an external force is applied to the limiting element, the external force results in a displacement of the limiting element, so that the limiting element is inserted into one of the base and the lamp body.

27 Claims, 8 Drawing Sheets

MOTION SENSITIVE LAMP WITH COUPLING MECHANISM

FIELD OF THE INVENTION

The present invention relates to a motion sensitive lamp, and more particularly to a motion sensitive lamp with a coupling mechanism.

BACKGROUND OF THE INVENTION

Generally, a motion sensitive lamp at least comprises a base and a lamp body. For installing the motion sensitive lamp on a wall or a ceiling, the base is firstly connected with a wire that is buried within the wall or the ceiling. Since electric power is transmitted to the base through the wire, the lamp body assembled with the base can be illuminated. However, the process of assembling the lamp body with the base still has some drawbacks. For example, it is difficult for the user to see the coupling structures of the lamp body and the base during the assembling process. Moreover, since the coupling structures of the lamp body and the base of the commercially-available motion sensitive lamp are very complicated, it is difficult to assemble the lamp body with the base or disassemble the lamp from the base.

Therefore, there is a need of providing a motion sensitive lamp that can be operated easily and assembled or disassembled quickly.

SUMMARY OF THE INVENTION

For solving the drawbacks of the conventional technologies, the present invention provides a motion sensitive lamp with a coupling mechanism. The motion sensitive lamp can be operated easily and assembled or disassembled quickly.

In accordance with an aspect of the present invention, a motion sensitive lamp is provided. The motion sensitive lamp at least includes a lamp body, a base and a coupling mechanism. The coupling mechanism includes an engaging structure, a positioning structure and a limiting element. Moreover, one of the engaging structure and the positioning structure is installed on the lamp body, and the other of the engaging structure and the positioning structure is installed on the base. The limiting element is installed on one of the lamp body and the base. The engaging structure is inserted into the positioning structure, so that the lamp body is locked on or coupled with the base. When an external force is applied to the limiting element, the external force results in a displacement of the limiting element. Consequently, the limiting element is inserted into one of the base and the lamp body.

In an embodiment, one of the engaging structure and the positioning structure is integrally formed with the lamp body, and the other of the engaging structure and the positioning structure is integrally formed with the base.

In an embodiment, the lamp body includes a coupling wall, the positioning structure is formed on an inner surface of the coupling wall, and the engaging structure is formed on the base.

In an embodiment, the engaging structure is a convex structure, and the positioning structure is a concave structure corresponding to the convex structure. The limiting element is pushed against or contacted with a portion of the convex structure in response to the displacement, so that the lamp body and the base are limited.

In an embodiment, the positioning structure includes a first positioning part and a second positioning part. When the lamp body is assembled with the base, the engaging structure is clamped between the first positioning part and the second positioning part, a first contact surface of the engaging structure is pushed against or contacted with the first positioning part, and a second contact surface of the engaging structure is pushed against or contacted with the second positioning part.

In an embodiment, the limiting element is installed on the coupling wall, and opposed to the second positioning part along an axial direction. When the first contact surface of the engaging structure is pushed against or contacted with the first positioning part, the limiting element is pushed against or contacted with the second contact surface of the engaging structure in response to the displacement. Consequently, the engaging structure is clamped and limited by the limiting element.

In an embodiment, the limiting element is a rotary element or a pressing element. When the external force results in the displacement of the limiting element, the limiting element is engaged with or disengaged from the second contact surface of the engaging structure.

In an embodiment, the limiting element includes a stopping part. The stopping part is engaged with or disengaged from the second contact surface of the engaging structure in response to the displacement.

In an embodiment, the base includes a first electric terminal, and the lamp body includes a second electric terminal corresponding to the first electric terminal. When the lamp body and base are coupled with each other through the coupling mechanism, the first electric terminal and the second electric terminal are electrically connected with each other.

In an embodiment, the base further includes a junction box, and at least one wire is electrically connected with the first electric terminal through the junction box.

In an embodiment, the lamp body includes a light-emitting element and a human sensor. The light-emitting element is electrically connected with the human sensor. The human sensor detects whether a human body enters a sensitive range. If the human sensor detects that the human body enters the sensitive range, the human sensor generates a human sensing signal, and the light-emitting element emits plural light beams in response to the human sensing signal.

In an embodiment, the human sensor includes at least one of a passive infrared motion sensor and a microwave sensor.

In an embodiment, the lamp body further includes a light-transmissible element. The light-transmissible element includes a first light-outputting surface, a second light-outputting surface and plural microstructures. The second light-outputting surface is opposed to the first light-outputting surface. The plural microstructures are formed on at least one of the first light-outputting surface and the second light-outputting surface. A travelling direction of the plural light beams and the plural microstructures are in a vertical interference relationship or a non-parallel interference relationship.

In an embodiment, the plural microstructures are V-shaped optical refractive structures, U-shaped optical refractive structures, curvy optical refractive structures, or the combination thereof.

If the light beams are not received by the plural microstructures, the light-transmissible element is in a visual penetration state. Whereas, if the light beams are received and refracted by the plural microstructures, the light-transmissible element is in an illumination state.

In accordance with another aspect of the present invention, a motion sensitive lamp is provided. The motion sensitive lamp at least includes a lamp body, a base and coupling mechanism. The lamp body includes a light-emitting element and a human sensor. The light-emitting element is electrically connected with the human sensor. The coupling mechanism includes an engaging structure, a positioning structure and a limiting element. Moreover, one of the engaging structure and the positioning structure is installed on the lamp body, and the other of the engaging structure and the positioning structure is installed on the base. The limiting element is installed on one of the lamp body and the base. The engaging structure is inserted into the positioning structure, so that the lamp body is locked on or coupled with the base. When an external force is applied to the limiting element, the external force results in a displacement of the limiting element. Consequently, the limiting element is inserted into one of the base and the lamp body.

In an embodiment, the human sensor includes at least one of a passive infrared motion sensor and a microwave sensor.

In an embodiment, the human sensor detects whether a human body enters a sensitive range. If the human sensor detects that the human body enters the sensitive range, the human sensor generates a human sensing signal, and the light-emitting element emits plural light beams in response to the human sensing signal.

In an embodiment, one of the engaging structure and the positioning structure is integrally formed with the lamp body, and the other of the engaging structure and the positioning structure is integrally formed with the base.

In an embodiment, the lamp body includes a coupling wall, the positioning structure is formed on an inner surface of the coupling wall, and the engaging structure is formed on the base.

In an embodiment, the engaging structure is a convex structure, and the positioning structure is a concave structure corresponding to the convex structure. The limiting element is pushed against or contacted with a portion of the convex structure in response to the displacement, so that the lamp body and the base are limited.

In an embodiment, the positioning structure includes a first positioning part and a second positioning part. When the lamp body is assembled with the base, the engaging structure is clamped between the first positioning part and the second positioning part, a first contact surface of the engaging structure is pushed against or contacted with the first positioning part, and a second contact surface of the engaging structure is pushed against or contacted with the second positioning part.

In an embodiment, the limiting element is installed on the coupling wall, and opposed to the second positioning part. When the first contact surface of the engaging structure is pushed against the first positioning part, the limiting element is pushed against or contacted with the second contact surface of the engaging structure in response to the displacement. Consequently, the engaging structure is clamped and limited by the limiting element.

In an embodiment, the limiting element is a rotary element or a pressing element. When the external force results in the displacement of the limiting element, the limiting element is engaged with or disengaged from the second contact surface of the engaging structure.

In an embodiment, the limiting element includes a stopping part. The stopping part is engaged with or disengaged from the second contact surface of the engaging structure in response to the displacement.

In an embodiment, the base includes a first electric terminal, and the lamp body includes a second electric terminal corresponding to the first electric terminal. When the lamp body and base are coupled with each other through the coupling mechanism, the first electric terminal and the second electric terminal are electrically connected with each other.

In an embodiment, the base further includes a junction box, and at least one wire is electrically connected with the first electric terminal through the junction box.

From the above descriptions, the motion sensitive lamp of the present invention includes the engaging structure, the positioning structure and the limiting element. The engaging structure and the positioning structure are engaged with or coupled with each other. When an external force is applied to the limiting element to result in a displacement of the limiting element, the connection relationship between the lamp body and the base is limited. In other words, it is not necessary to use an additional tool to assembly the lamp body with the base. Since the procedures of assembling the motion sensitive lamp are reduced, the motion sensitive lamp can be assembled or disassembled simply and quickly.

DETAILED DESCRIPTION OF THE PREFERRED EMBODIMENT

The embodiments of present invention will be described more specifically with reference to the following drawings. In the following embodiments and drawings, the elements irrelevant to the concepts of the present invention or the elements well known to those skilled in the art are omitted. It is noted that numerous modifications and alterations may be made while retaining the teachings of the invention.

Figure 1A:
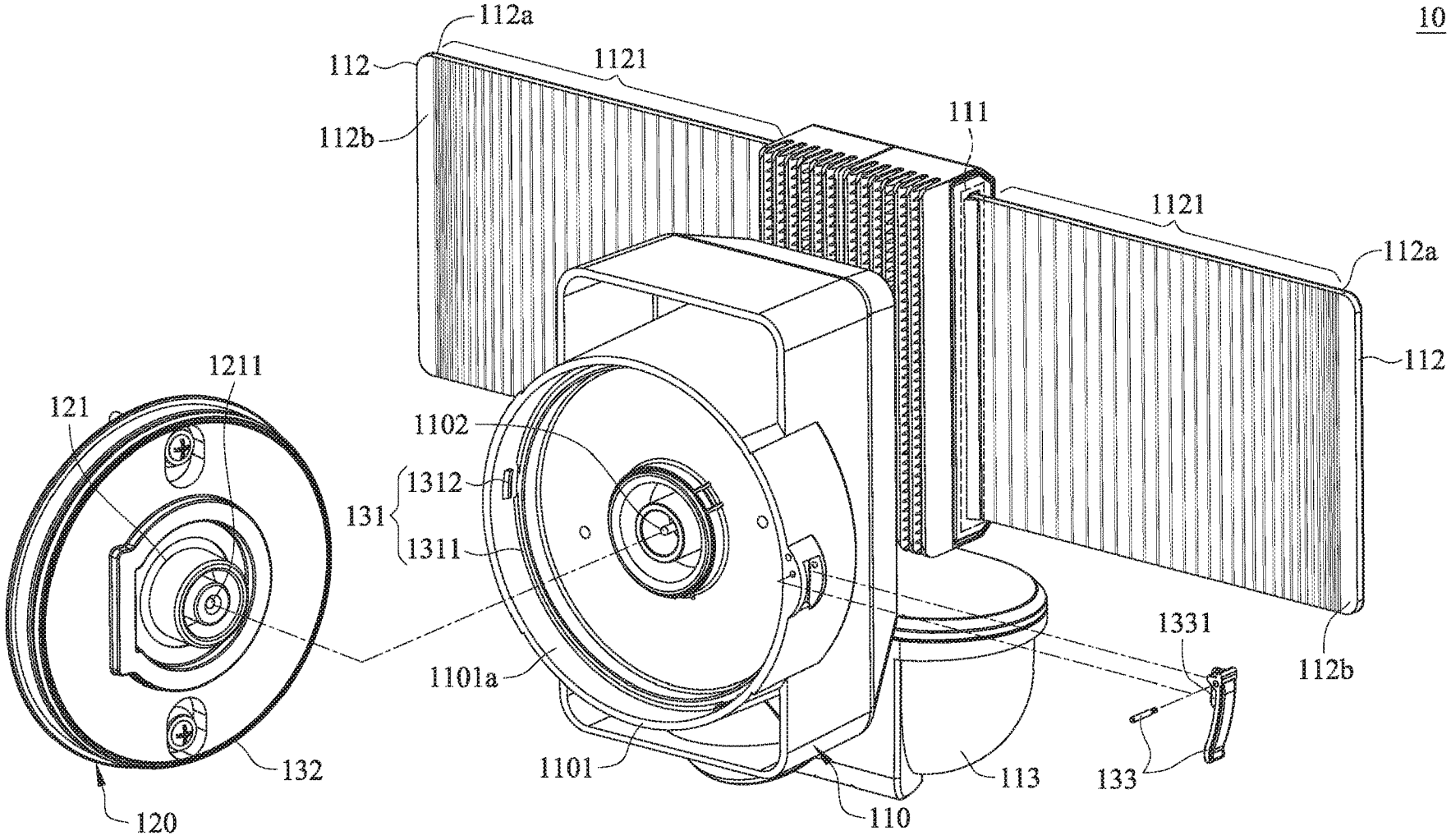
FIGS. 1A and 1B are schematic exploded views illustrating a motion sensitive lamp according to an embodiment of the present invention and taken along different viewpoints.
Figure 1B:
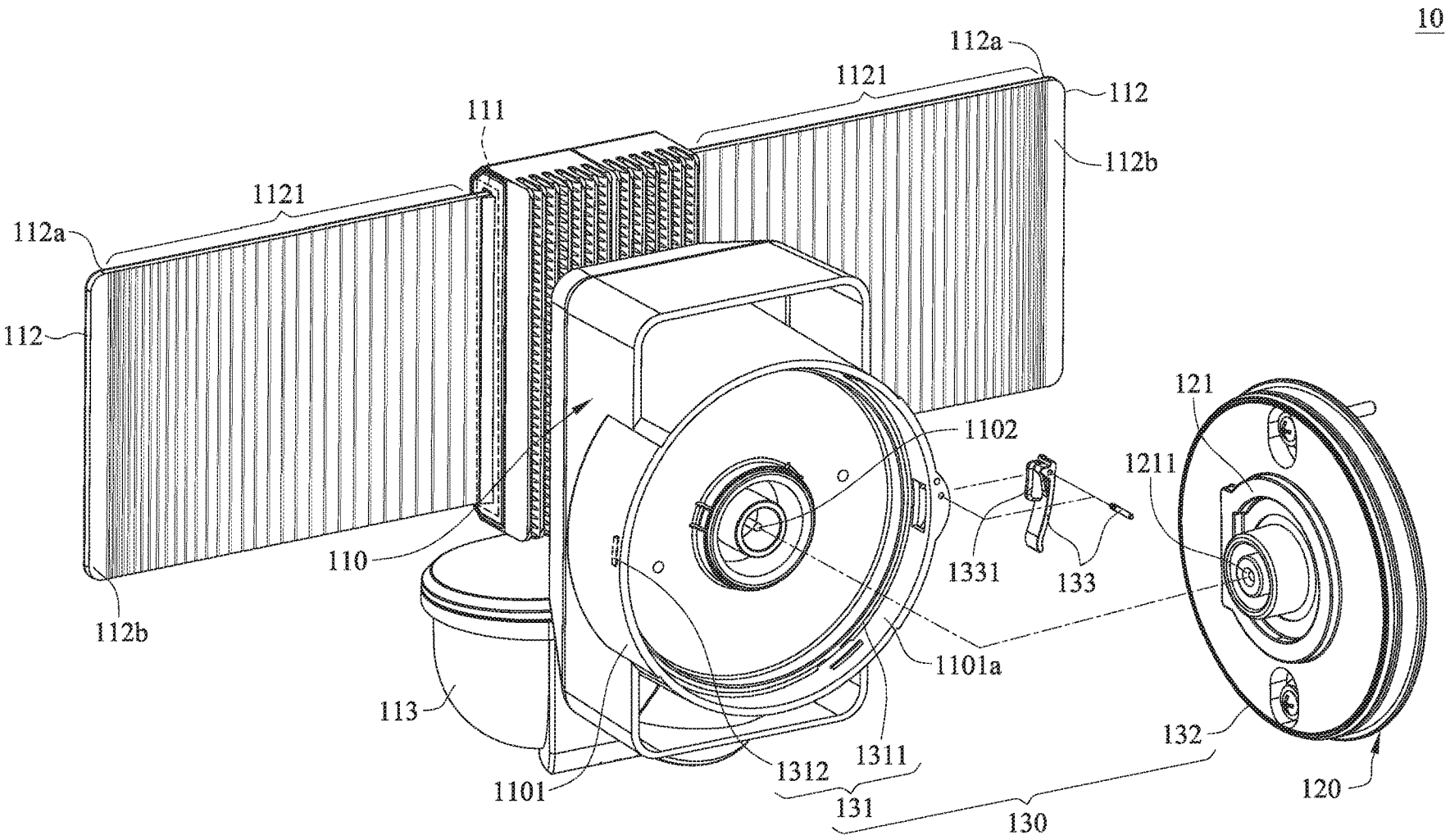
Figure 2A:
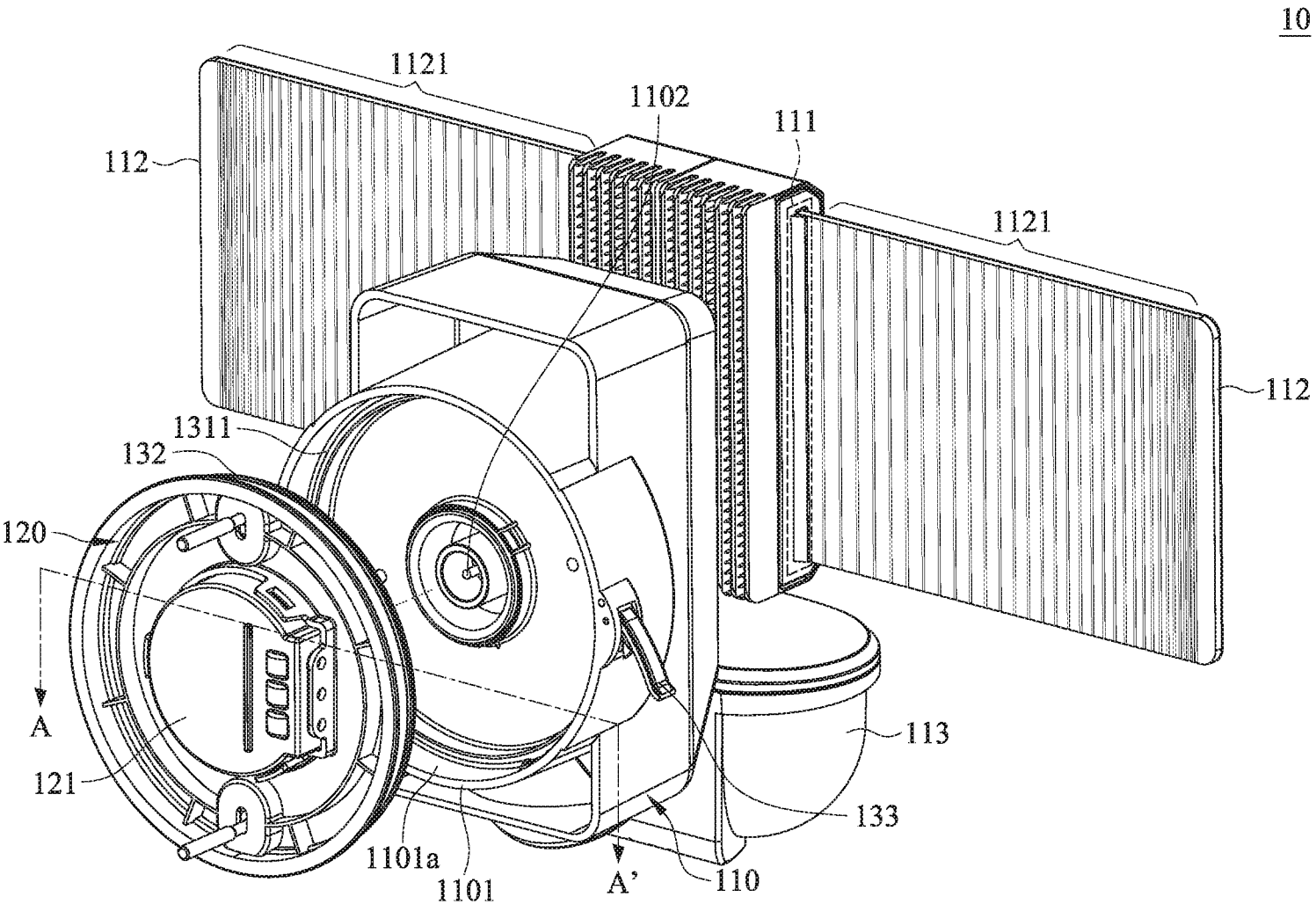
FIG. 2A is a schematic exploded view illustrating a portion of the motion sensitive lamp as shown in FIG. 1A.
Figure 2B:
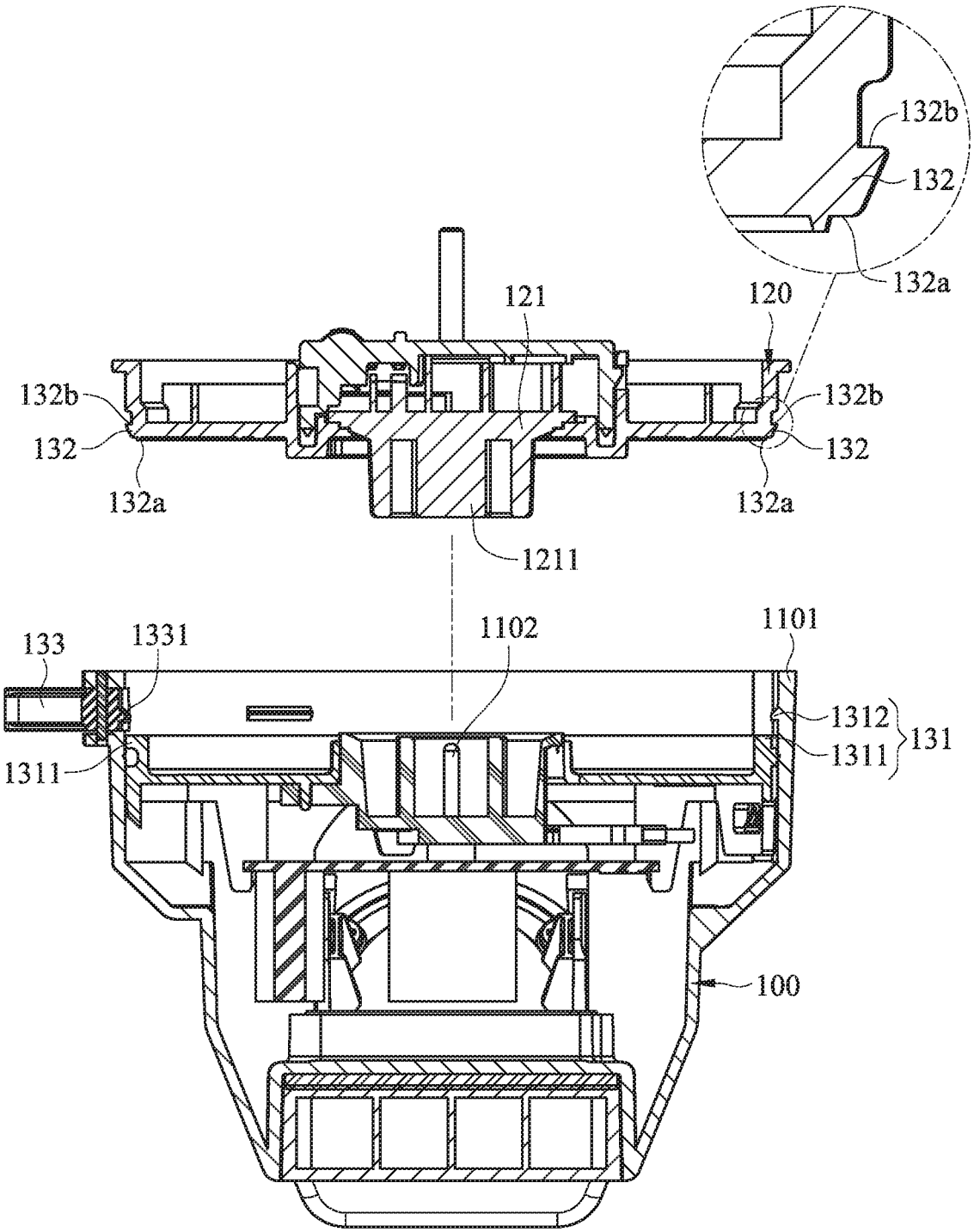
FIG. 2B is a schematic cross-sectional view illustrating a portion of the motion sensitive lamp according to the embodiment of the present invention.

Please refer to FIGS. 1A, 1B, 2A and 2B. FIGS. 1A and 1B are schematic exploded views illustrating a motion sensitive lamp according to an embodiment of the present invention and taken along different viewpoints. FIG. 2A is a schematic exploded view illustrating a portion of the motion sensitive lamp as shown in FIG. 1A. FIG. 2B is a schematic cross-sectional view illustrating a portion of the motion sensitive lamp according to the embodiment of the present invention. The structure of the motion sensitive lamp will be illustrated with reference to these drawings.

As shown in FIGS. 1A, 1B, 2A and 2B, the motion sensitive lamp 10 comprises a lamp body 110, a base 120 and a coupling mechanism 130. The lamp body 110 is selectively coupled with or detached from the base 120 through the coupling mechanism 130. When the lamp body 110 is coupled with the base 120, the lamp body 110 is and the base 120 are electrically connected with each other. Alternatively, the lamp body 110 and the base 120 are easily and quickly detached from each other in response to an external force.

The lamp body 110 comprises a coupling wall 1101, a first electric terminal 1102, a light-emitting element 111, a light-transmissible element 112 and a human sensor 113. The coupling wall 1101 is located at a first side of the lamp body 110 and protruded toward the base 120. In an embodiment, the coupling wall 1101 is a cup-shaped protrusion structure including a bottom plate (not shown) and a ring-shaped structure. When the coupling wall 1101 is connected with the base 120, the base 120 is accommodated within the coupling wall 1101. The first electric terminal 1102 is arranged between the coupling wall 1101 and the base 120. The light-transmissible element 112 and the human sensor 113 are installed on the lamp body 110. It is noted that the profile of the coupling wall 1101 may be varied according to the practical requirements.

The light-transmissible element 112 comprises a first light-outputting surface 112*a*, a second light-outputting surface 112*b* and plural microstructures 1121. The plural microstructures 1121 are formed on the second light-outputting surface 112*b*. In an embodiment, the spacing intervals between adjacent microstructures 1121 are gradually decreased along the direction away from the light-emitting element 111. The light-emitting element 111 is disposed within the lamp body 110 and located near the light-transmissible element 112. Moreover, the light-emitting element 111 is electrically connected with the human sensor 113. The human sensor 113 is used for detecting whether a human body enters a sensitive range. If the human sensor 113 detects that a human body enters the sensitive range, the human sensor 113 generates a human sensing signal. In response to the human sensing signal, the light-emitting element 111 emits plural light beams. An example of the human sensor 113 includes but is not limited to a passive infrared (PIR) motion sensor or a microwave sensor.

The base 120 comprises a junction box 121 with a second electric terminal 1211. The junction box 121 is located at a first side of the base 120 that faces the coupling wall 1101. Moreover, the second electric terminal 1211 is disposed within the junction box 121 and aligned with the first electric terminal 1102. When the lamp body 110 is coupled with the base 120 through the coupling mechanism 130, the first electric terminal 1102 and the second electric terminal 1211 are electrically connected with each other. Consequently, the lamp body 110 and the base 120 can be coupled with each other in a simple manner and electrically connected with each other quickly.

The coupling mechanism 130 comprises a positioning structure 131, an engaging structure 132 and a limiting element 133.

The positioning structure 131 comprises a first positioning part 1311 and a second positioning part 1312. The first positioning part 1311 and the second positioning part 1312 are formed on an inner surface 1101*a* of the coupling wall 1101. Moreover, the second positioning part 1312 is closer to the base 120 than the first positioning part 1311. In an embodiment, the first positioning part 1311 is a ring-shaped protrusion edge 1311, and the second positioning part 1312 is a bulge. The bulge 1312 is located near the ring-shaped protrusion edge 1311. Moreover, there is a gap (not shown) between the ring-shaped protrusion edge 1311 and the bulge 1312.

The limiting element 133 comprises a stopping structure 1331. The limiting element 133 is installed on the coupling wall 1101. Moreover, the limiting element 133 and the second positioning part 1312 (e.g., a bulge) are opposed to each other along an axial direction. While the lamp body 110 and the base 120 are combined together, an external force is applied to the limiting element 133 to result in a displacement of the limiting element 133. Consequently, the stopping structure 1331 is inserted into the base 120. In an embodiment, the limiting element 133 is a rotary element 133. In response to the external force, the rotary element 133 is rotated in a clockwise direction or a counterclockwise direction.

Figure 3A:
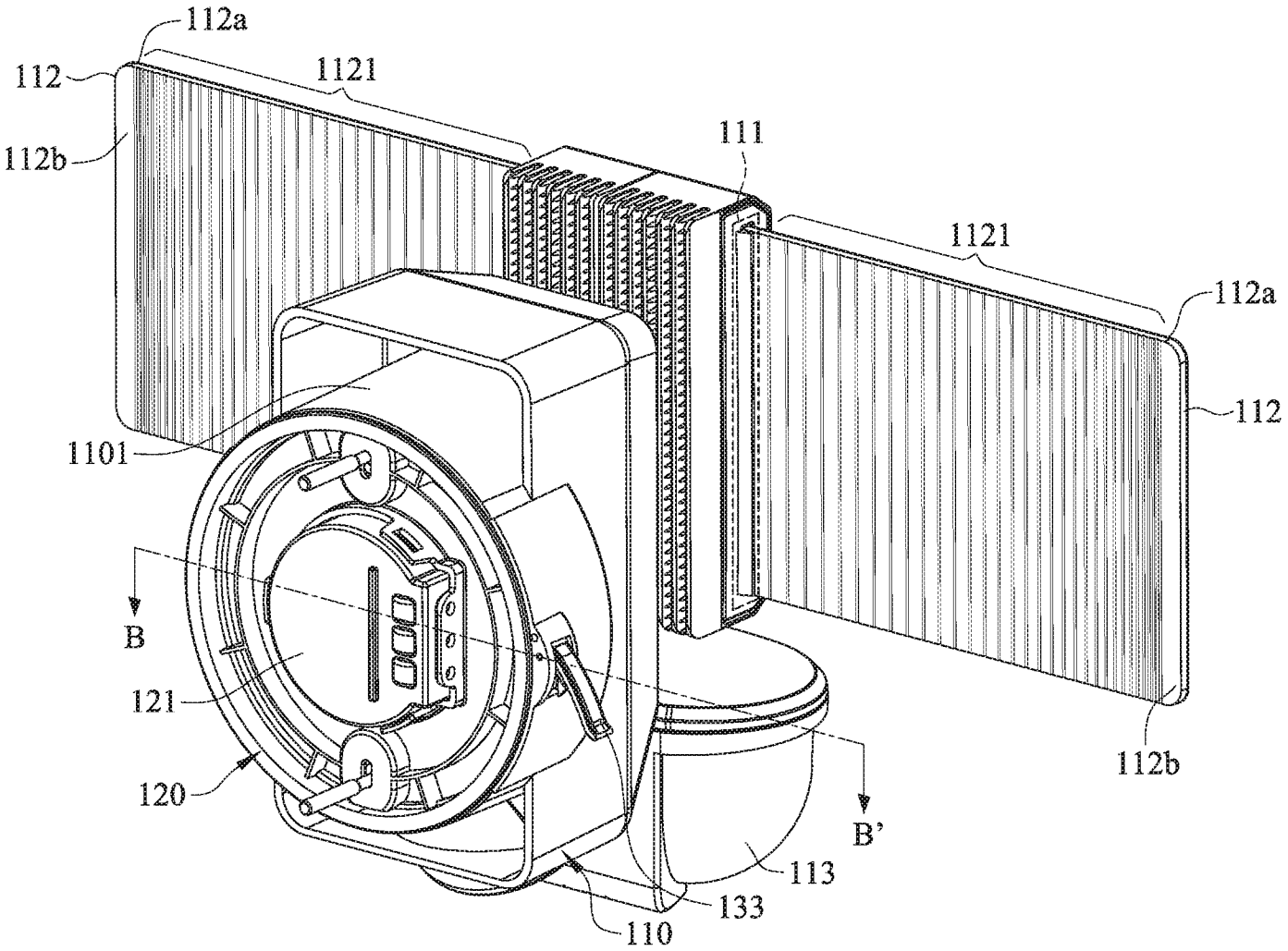
FIG. 3A is a schematic perspective view illustrating the assembled structure of the motion sensitive lamp as shown in FIG. 2A.
Figure 3B:
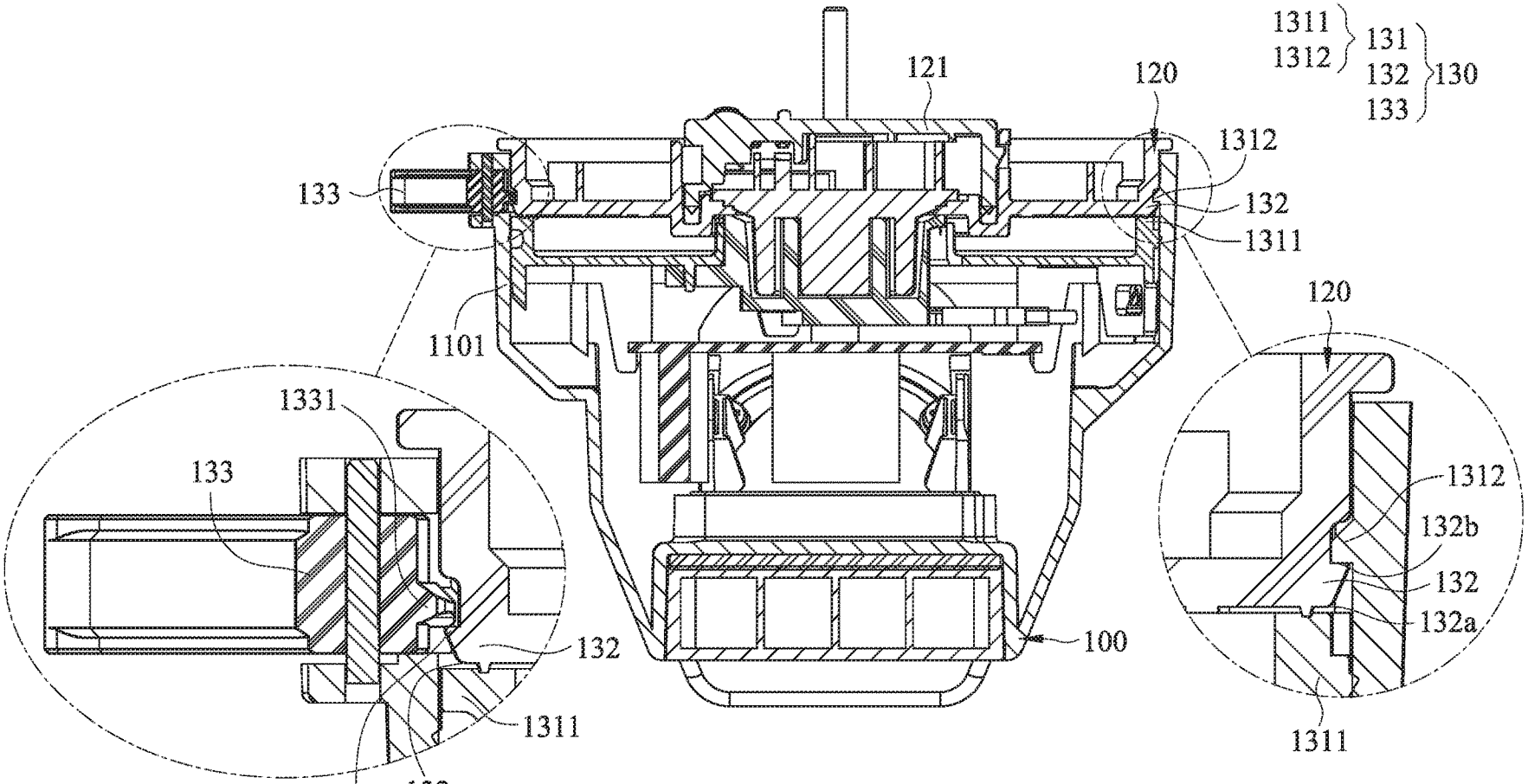
FIG. 3B is a schematic cross-sectional view illustrating a portion of the motion sensitive lamp according to the embodiment of the present invention.
Figure 4A:
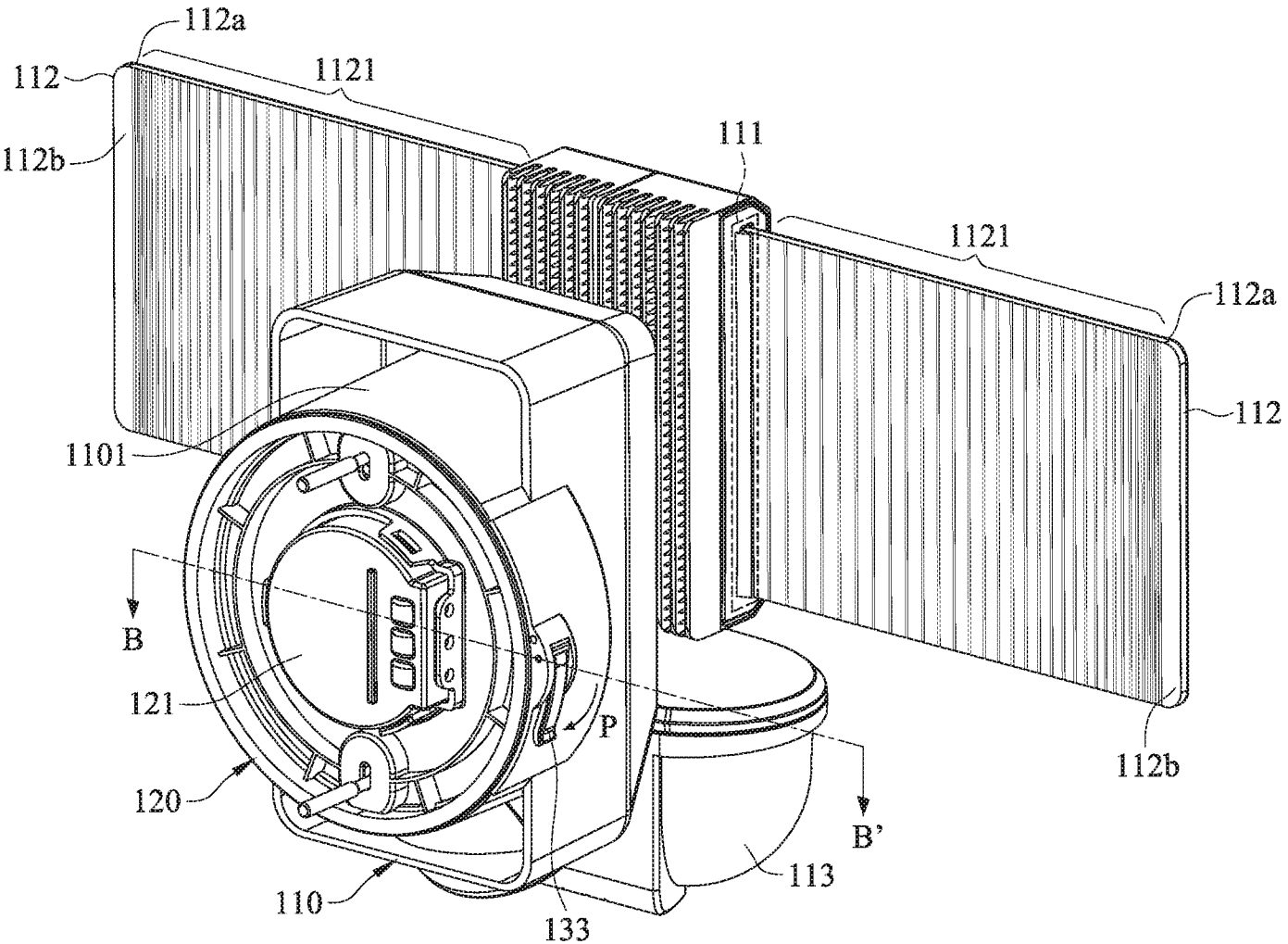
FIG. 4A is a schematic perspective view illustrating the motion sensitive lamp as shown in FIG. 3A, in which the limiting element is inserted into the base.
Figure 4B:
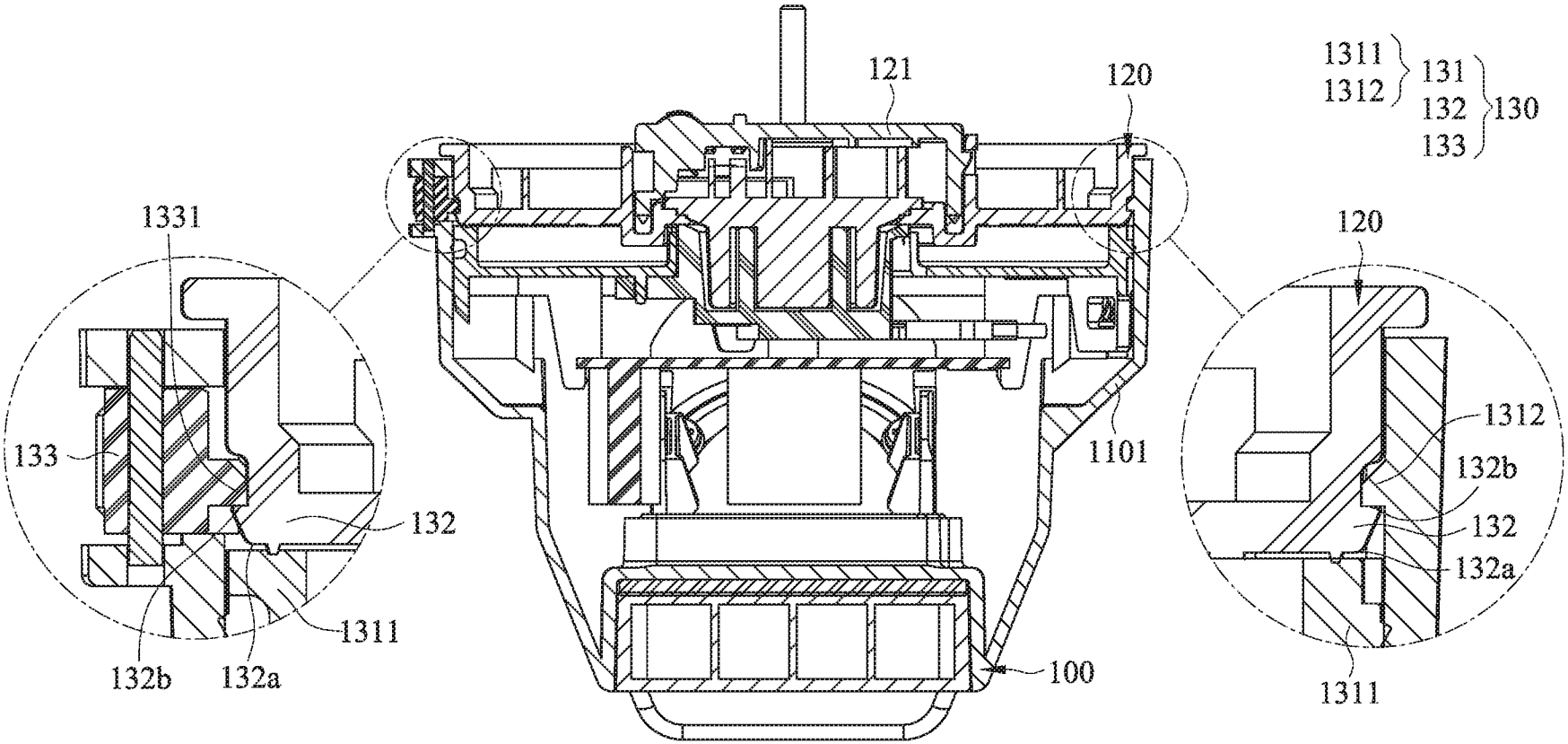
FIG. 4B is a schematic cross-sectional view illustrating a portion of the motion sensitive lamp as shown in FIG. 4A.

A process of assembling the lamp body 110 with the base 120 will be described as follows. Please refer to FIGS. 3A, 3B, 4A and 4B. FIG. 3A is a schematic perspective view illustrating the assembled structure of the motion sensitive lamp as shown in FIG. 2A. FIG. 3B is a schematic cross-sectional view illustrating a portion of the motion sensitive lamp according to the embodiment of the present invention. FIG. 4A is a schematic perspective view illustrating the motion sensitive lamp as shown in FIG. 3A, in which the limiting element is inserted into the base. FIG. 4B is a schematic cross-sectional view illustrating a portion of the motion sensitive lamp as shown in FIG. 4A.

Please refer to FIGS. 3A and 3B. When the lamp body 110 is assembled with the base 120, the engaging structure 132 on the base 120 is pushed against or contacted with the ring-shaped protrusion edge 1311. A portion of the engaging structure 132 is clamped between the ring-shaped protrusion edge 1311 and the bulge 1312. For example, a first contact surface 132*a* of the engaging structure 132 is pushed against or contacted with the ring-shaped protrusion edge 1311, and a second contact surface 132*b* of the engaging structure 132 is pushed against or contacted with the bulge 1312. Moreover, another portion of the engaging structure 132 near the limiting element 133 (e.g., the rotary element 133) is pushed against or contacted with the ring-shaped protrusion edge 1311. When the ring-shaped protrusion edge 1311 and the bulge 1312 are engaged with the engaging structure 132, the first electric terminal 1102 and the second electric terminal 1211 are electrically connected with each other.

Please refer to FIGS. 4A and 4B. When an external force P in a clockwise direction is applied to the rotary element 133 on the coupling wall 1101, the rotary element 133 is rotated in the clockwise direction. Consequently, the stopping structure 1331 is inserted into the base 120, and the stopping structure 1331 is pushed against or contacted with the second contact surface 132*b* of the engaging structure 132. In such way, the engaging structure 132 is clamped between the stopping structure 1331 and the ring-shaped protrusion edge 1311. That is, the lamp body 110 and the base 120 are fixedly coupled with each other.

When an external force P in a counterclockwise direction is applied to the rotary element 133, the rotary element 133 is rotated in the counterclockwise direction. Consequently, the stopping structure 1331 is disengaged from the base 120, and the stopping structure 1331 is separated from the second contact surface 132*b* of the engaging structure 132. In such way, the lamp body 110 and the base 120 are separated or detached from each other. When the ring-shaped protrusion edge 1311 and the bulge 1312 are disengaged from the engaging structure 132, the first electric terminal 1102 and the second electric terminal 1211 are separated or detached from each other.

As mentioned above, the lamp body 110 and the base 120 are coupled with and electrically connected with each other through the engagement between the positioning structure 131 and the engaging structure 132. When an external force is applied to the rotary element 133 to result in a displacement of the rotary element 133, the connection relationship between the lamp body 110 and the base 120 is limited. Alternatively, when the stopping structure 1331 is separated from the second contact surface 132*b* of the engaging structure 132, the lamp body 110 and the base 120 are separated or detached from each other quickly.

It is noted that numerous modifications and alterations may be made while retaining the teachings of the invention. That is, the structural designs and specifications of the components may be varied according to the practical requirements.

For example, the coupling mechanism may have various modifications. In another embodiment, one of the engaging structure and the positioning structure is installed on the lamp body, and the other of the engaging structure and the positioning structure is installed on the base. Moreover, the limiting element is installed on one of the lamp body and the base. When the lamp body and the base are coupled with each other, the limiting element is inserted into the other of the of the lamp body and the base. Preferably but not exclusively, one of the engaging structure and the positioning structure is integrally formed with the lamp body, and the other of the engaging structure and the positioning structure is integrally formed with the base.

In another embodiment, the engaging structure is a convex structure, and the positioning structure is a concave structure. When the convex structure is received within the concave structure, the limiting element is pushed against or contacted with a portion of the convex structure in response to the displacement. Consequently, the lamp body and base are limited by the limiting element. The example of the liming element is not restricted to the rotary element. For example, a variant example of the liming element is a pressing element. When an external force is applied on the pressing element to result in a displacement of the pressing element, the stopping part is inserted into at least one of the lamp body and the base to limit the lamp body and the base.

The microstructures of the light-transmissible element may be designed according to the practical requirements. For example, a spacing interval between two adjacent microstructures of the plural microstructures is different from a spacing interval between other two adjacent microstructures of the plural microstructures, or a spacing interval between every two adjacent microstructures of the plural microstructures is gradually decreased or increased along a direction away from the light-emitting element, or a depth of each microstructure relative to the light-outputting surface is gradually decreased or increased along a direction away from the light-emitting element. In another embodiment, the plural microstructures are formed on the first light-outputting surface.

The plural microstructures are V-shaped optical refractive structures, U-shaped optical refractive structures, curvy optical refractive structures, or the combination thereof. In case that the plural light beams are not received by the plural microstructures, the light-transmissible element is in a visual penetration state. In case that the plural light beams are received and refracted by the plural microstructures, the light-transmissible element is in an illumination state. Moreover, a travelling direction of the plural light beams and the plural microstructures are in a vertical interference relationship or a non-parallel interference relationship.

From the above descriptions, the motion sensitive lamp of the present invention includes the engaging structure, the positioning structure and the limiting element. The engaging structure and the positioning structure are engaged with or coupled with each other. When an external force is applied to the limiting element to result in a displacement of the limiting element, the connection relationship between the lamp body and the base is limited. In other words, it is not necessary to use an additional tool to assembly the lamp body with the base. Since the procedures of assembling the motion sensitive lamp are reduced, the motion sensitive lamp can be assembled simply and quickly.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A motion sensitive lamp, at least comprising:

a lamp body;

a base; and a coupling mechanism comprising an engaging structure, a positioning structure and a limiting element, wherein one of the engaging structure and the positioning structure is installed on the lamp body, and the other of the engaging structure and the positioning structure is installed on the base, wherein the limiting element is installed on one of the lamp body and the base;

wherein the engaging structure is inserted into the positioning structure, so that the lamp body is locked on or coupled with the base, wherein when an external force is applied to the limiting element, the external force results in a displacement of the limiting element, so that the limiting element is inserted into one of the base and the lamp body.

2. The motion sensitive lamp according to claim 1, wherein one of the engaging structure and the positioning structure is integrally formed with the lamp body, and the other of the engaging structure and the positioning structure is integrally formed with the base.

3. The motion sensitive lamp according to claim 1, wherein the lamp body comprises a coupling wall, the positioning structure is formed on an inner surface of the coupling wall, and the engaging structure is formed on the base.

4. The motion sensitive lamp according to claim 3, wherein the engaging structure is a convex structure, and the positioning structure is a concave structure corresponding to the convex structure, wherein the limiting element is pushed against or contacted with a portion of the convex structure in response to the displacement, so that the lamp body and the base are limited.

5. The motion sensitive lamp according to claim 3, wherein the positioning structure comprises a first positioning part and a second positioning part, wherein when the lamp body is assembled with the base, the engaging structure is clamped between the first positioning part and the second positioning part, a first contact surface of the engaging structure is pushed against or contacted with the first positioning part, and a second contact surface of the engaging structure is pushed against or contacted with the second positioning part.

6. The motion sensitive lamp according to claim 5, wherein the limiting element is installed on the coupling wall, and opposed to the second positioning part along an axial direction, wherein when the first contact surface of the engaging structure is pushed against or contacted with the first positioning part, the limiting element is pushed against or contacted with the second contact surface of the engaging structure in response to the displacement, so that the engaging structure is clamped and limited by the limiting element.

7. The motion sensitive lamp according to claim 6, wherein the limiting element is a rotary element or a pressing element, wherein when the external force results in the displacement of the limiting element, the limiting element is engaged with or disengaged from the second contact surface of the engaging structure.

8. The motion sensitive lamp according to claim 6, wherein the limiting element comprises a stopping part, wherein the stopping part is engaged with or disengaged from the second contact surface of the engaging structure in response to the displacement.

9. The motion sensitive lamp according to claim 1, wherein the base comprises a first electric terminal, and the lamp body comprises a second electric terminal corresponding to the first electric terminal, wherein when the lamp body and base are coupled with each other through the coupling mechanism, the first electric terminal and the second electric terminal are electrically connected with each other.

10. The motion sensitive lamp according to claim 9, wherein the base further comprises a junction box, and at least one wire is electrically connected with the first electric terminal through the junction box.

11. The motion sensitive lamp according to claim 1, wherein the lamp body comprises a light-emitting element and a human sensor, wherein the light-emitting element is electrically connected with the human sensor, and the human sensor detects whether a human body enters a sensitive range, wherein if the human sensor detects that the human body enters the sensitive range, the human sensor generates a human sensing signal, and the light-emitting element emits plural light beams in response to the human sensing signal.

12. The motion sensitive lamp according to claim 11, wherein the human sensor comprises at least one of a passive infrared motion sensor and a microwave sensor.

13. The motion sensitive lamp according to claim 11, wherein the lamp body further comprises a light-transmissible element, and the light-transmissible element comprises:

a first light-outputting surface;

a second light-outputting surface opposed to the first light-outputting surface; and plural microstructures formed on at least one of the first light-outputting surface and the second light-outputting surface, wherein a travelling direction of the plural light beams and the plural microstructures are in a vertical interference relationship or a non-parallel interference relationship.

14. The motion sensitive lamp according to claim 13, wherein the plural microstructures are V-shaped optical refractive structures, U-shaped optical refractive structures, curvy optical refractive structures, or the combination thereof.

15. The motion sensitive lamp according to claim 13, wherein if the light beams are not received by the plural microstructures, the light-transmissible element is in a visual penetration state, wherein if the light beams are received and refracted by the plural microstructures, the light-transmissible element is in an illumination state.

16. A motion sensitive lamp, at least comprising:

a lamp body comprising a light-emitting element and a human sensor, wherein the light-emitting element is electrically connected with the human sensor;

a base; and a coupling mechanism comprising an engaging structure, a positioning structure and a limiting element, wherein one of the engaging structure and the positioning structure is installed on the lamp body, and the other of the engaging structure and the positioning structure is installed on the base, wherein the limiting element is installed on one of the lamp body and the base;

wherein the engaging structure is inserted into the positioning structure, so that the lamp body is locked on or coupled with the base, wherein when an external force is applied to the limiting element, the external force results in a displacement of the limiting element, so that the limiting element is inserted into one of the base and the lamp body.

17. The motion sensitive lamp according to claim 16, wherein the human sensor comprises at least one of a passive infrared motion sensor and a microwave sensor.

18. The motion sensitive lamp according to claim 16, wherein the human sensor detects whether a human body enters a sensitive range, wherein if the human sensor detects that the human body enters the sensitive range, the human sensor generates a human sensing signal, and the light-emitting element emits plural light beams in response to the human sensing signal.

19. The motion sensitive lamp according to claim 18, wherein one of the engaging structure and the positioning structure is integrally formed with the lamp body, and the other of the engaging structure and the positioning structure is integrally formed with the base.

20. The motion sensitive lamp according to claim 18, wherein the lamp body comprises a coupling wall, the positioning structure is formed on an inner surface of the coupling wall, and the engaging structure is formed on the base.

21. The motion sensitive lamp according to claim 20, wherein the engaging structure is a convex structure, and the positioning structure is a concave structure corresponding to the convex structure, wherein the limiting element is pushed against or contacted with a portion of the convex structure in response to the displacement, so that the lamp body and the base are limited.

22. The motion sensitive lamp according to claim 20, wherein the positioning structure comprises a first positioning part and a second positioning part, wherein when the lamp body is assembled with the base, the engaging structure is clamped between the first positioning part and the second positioning part, a first contact surface of the engaging structure is pushed against or contacted with the first positioning part, and a second contact surface of the engaging structure is pushed against or contacted with the second positioning part.

23. The motion sensitive lamp according to claim 22, wherein the limiting element is installed on the coupling wall, and opposed to the second positioning part, wherein when the first contact surface of the engaging structure is pushed against the first positioning part, the limiting element is pushed against or contacted with the second contact surface of the engaging structure in response to the displacement, so that the engaging structure is clamped and limited by the limiting element.

24. The motion sensitive lamp according to claim 22, wherein the limiting element is a rotary element or a pressing element, wherein when the external force results in the displacement of the limiting element, the limiting element is engaged with or disengaged from the second contact surface of the engaging structure.

25. The motion sensitive lamp according to claim 22, wherein the limiting element comprises a stopping part, wherein the stopping part is engaged with or disengaged from the second contact surface of the engaging structure in response to the displacement.

26. The motion sensitive lamp according to claim 16, wherein the base comprises a first electric terminal, and the lamp body comprises a second electric terminal corresponding to the first electric terminal, wherein when the lamp body and base are coupled with each other through the coupling mechanism, the first electric terminal and the second electric terminal are electrically connected with each other.

27. The motion sensitive lamp according to claim 26, wherein the base further comprises a junction box, and at least one wire is electrically connected with the first electric terminal through the junction box.

* * * * *